US009086007B2

(12) United States Patent
Baig et al.

(10) Patent No.: US 9,086,007 B2
(45) Date of Patent: Jul. 21, 2015

(54) SYSTEM AND METHOD FOR ACCOMMODATING AFTERTREATMENT BRICKS

(71) Applicant: Caterpillar Inc., Peoria, IL (US)

(72) Inventors: Mirza P. Baig, Peoria, IL (US); Andrew M. Denis, Peoria, IL (US); Kristian Engelsen, Peoria, IL (US); Pradyumna V. Rao, Peoria, IL (US); Raymond U. Isada, Peoria, IL (US); Raymond B. Gerges, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 188 days.

(21) Appl. No.: 13/724,064

(22) Filed: Dec. 21, 2012

(65) Prior Publication Data

US 2014/0174060 A1 Jun. 26, 2014

(51) Int. Cl.

| | |
|---|---|
| ***B01D 46/00*** | (2006.01) |
| ***F01N 3/28*** | (2006.01) |
| ***F01N 13/18*** | (2010.01) |
| *F01N 13/00* | (2010.01) |

(52) U.S. Cl.

CPC ..... *F01N 3/2839* (2013.01); *F01N 13/1855* (2013.01); *F01N 13/0097* (2014.06); *F01N 13/017* (2014.06); *F01N 2470/22* (2013.01); *Y10T 29/49815* (2015.01); *Y10T 29/49948* (2015.01)

(58) Field of Classification Search

CPC ..... B01D 46/10; B01D 46/0004; B01D 46/0005; B01D 46/001

USPC ..... 95/273

See application file for complete search history.

(56) References Cited

U.S. PATENT DOCUMENTS

| | | | | | |
|---|---|---|---|---|---|
| 3,442,067 | A | * | 5/1969 | Swenson | 55/482 |
| 3,740,933 | A | * | 6/1973 | Hollowell | 55/429 |
| 4,043,761 | A | * | 8/1977 | Gaysert et al. | 422/179 |
| 5,048,287 | A | * | 9/1991 | Howe et al. | 60/288 |
| 5,082,479 | A | | 1/1992 | Miller | |
| 5,167,683 | A | * | 12/1992 | Behrendt et al. | 55/478 |
| 5,169,604 | A | | 12/1992 | Crothers, Jr. | |
| 5,190,732 | A | * | 3/1993 | Maus et al. | 422/179 |
| 5,408,827 | A | | 4/1995 | Holtermann et al. | |
| 5,484,466 | A | * | 1/1996 | Brown et al. | 55/498 |
| 5,569,311 | A | * | 10/1996 | Oda et al. | 55/493 |

(Continued)

FOREIGN PATENT DOCUMENTS

| | | | |
|---|---|---|---|
| DE | 2422110 | A1 | 11/1975 |
| GB | 1052106 | A | 12/1966 |
| GB | 1410134 | A | 10/1975 |

*Primary Examiner* — Amber Orlando

(74) *Attorney, Agent, or Firm* — Leydig, Voit & Mayer, Ltd.

(57) ABSTRACT

One or more aftertreatment bricks are axially inserted through an opening in the first end of a tubular sleeve of an aftertreatment system. The aftertreatment brick includes a substrate matrix and a mantle disposed around the substrate matrix. The mantle further includes a lip arranged to extend through the opening of the sleeve. One or more channel pockets are secured proximate to the opening of the sleeve and oriented radially outward with respect to the sleeve axis. To retain the aftertreatment brick in the sleeve, a clamping assembly is used that includes a hook, a fastener, and a capture nut. The capture nut is installed and accommodated in the channel pockets. The hook engages the protruding lip of the aftertreatment brick and the fastener secures the hook to the capture nut received in the channel pocket.

15 Claims, 7 Drawing Sheets

(56) References Cited

U.S. PATENT DOCUMENTS

| | | | | | |
|---|---|---|---|---|---|
| 5,582,146 | A | * | 12/1996 | Linsbauer et al. | 123/198 E |
| 5,685,985 | A | * | 11/1997 | Brown et al. | 210/450 |
| 5,755,843 | A | * | 5/1998 | Sundquist | 55/385.3 |
| 5,897,676 | A | * | 4/1999 | Engel et al. | 55/498 |
| D417,268 | S | * | 11/1999 | Gillingham | D23/365 |
| 6,099,606 | A | * | 8/2000 | Miller et al. | 55/330 |
| 6,383,268 | B2 | * | 5/2002 | Oda | 96/134 |
| 6,660,235 | B1 | | 12/2003 | Holpp et al. | |
| 6,783,565 | B2 | * | 8/2004 | Gieseke et al. | 55/385.3 |
| 6,837,336 | B2 | * | 1/2005 | Gault et al. | 181/258 |
| 6,868,670 | B1 | * | 3/2005 | Schellin | 60/309 |
| 6,878,190 | B1 | * | 4/2005 | Xu et al. | 95/273 |
| 7,127,884 | B2 | * | 10/2006 | Worner et al. | 60/299 |
| 7,582,267 | B1 | * | 9/2009 | Klein et al. | 422/180 |
| 7,611,561 | B2 | * | 11/2009 | Hill et al. | 55/523 |
| 7,662,216 | B1 | * | 2/2010 | Terres et al. | 95/273 |
| 7,919,052 | B2 | | 4/2011 | Ahmed | |
| 7,976,604 | B2 | * | 7/2011 | Desjardins | 55/503 |
| 7,993,597 | B2 | | 8/2011 | Kinomoto et al. | |
| 8,062,602 | B2 | | 11/2011 | Roe et al. | |
| 8,105,409 | B2 | * | 1/2012 | Mann et al. | 55/483 |
| 8,302,306 | B2 | * | 11/2012 | Hill et al. | 29/890 |
| 8,361,181 | B2 | * | 1/2013 | Osendorf et al. | 55/498 |
| 8,454,898 | B2 | * | 6/2013 | Wirth | 422/179 |
| 8,480,778 | B2 | * | 7/2013 | Baseotto et al. | 55/498 |
| 8,486,173 | B2 | * | 7/2013 | Fikany et al. | 55/385.3 |
| 8,486,174 | B2 | * | 7/2013 | Gieseke et al. | 55/498 |
| 8,728,193 | B2 | * | 5/2014 | Flagstad et al. | 55/498 |
| 8,814,973 | B2 | * | 8/2014 | Baseotto et al. | 55/498 |
| 2001/0037631 | A1 | * | 11/2001 | Morgan et al. | 55/498 |
| 2002/0150518 | A1 | * | 10/2002 | Brush et al. | 422/180 |
| 2005/0036923 | A1 | * | 2/2005 | Brisbin et al. | 422/179 |
| 2005/0172588 | A1 | * | 8/2005 | Geise et al. | 55/410 |
| 2007/0011874 | A1 | * | 1/2007 | Myers | 29/890 |
| 2007/0144126 | A1 | * | 6/2007 | Ohya et al. | 55/502 |
| 2009/0158721 | A1 | * | 6/2009 | Wieland et al. | 60/297 |
| 2009/0208393 | A1 | * | 8/2009 | Wenzel et al. | 423/213.2 |
| 2009/0266065 | A1 | * | 10/2009 | Barrieu et al. | 60/323 |
| 2009/0272106 | A1 | * | 11/2009 | Werni et al. | 60/297 |
| 2011/0223819 | A1 | | 9/2011 | Kazuta | |
| 2011/0252776 | A1 | * | 10/2011 | Schwarz et al. | 60/324 |
| 2013/0014479 | A1 | * | 1/2013 | Mann et al. | 55/493 |

* cited by examiner

SYSTEM AND METHOD FOR ACCOMMODATING AFTERTREATMENT BRICKS

TECHNICAL FIELD

This patent disclosure relates generally to an aftertreatment system for reducing emissions in exhaust gasses from a combustion process and, more particularly, to a method and arrangement for accommodating the replaceable aftertreatment bricks in such a system.

BACKGROUND

Power systems such as, for example, large internal combustion engines burn hydrocarbon-based fuels or similar fuel sources to convert the chemical energy therein to mechanical energy that can be utilized to power an associated machine or application. Combustion of the hydrocarbon fuel may release or create several byproducts or emissions, such as nitrogen oxides ($NO_X$), carbon monoxides and carbon dioxides (CO and $CO_2$), and particulate matter. The quantity of some of these emissions that may be released to the environment may be subject to government regulations and environmental laws. Accordingly, manufacturers of such power systems may equip the system with an associated aftertreatment system to treat the emissions before they discharged to the environment.

The aftertreatment system can be disposed in the exhaust channel of the power system and may include a unit or module through which the exhaust gasses may pass. The module may include one or more aftertreatment bricks that may chemically or physically change the composition of the exhaust gasses that encounter the bricks. Examples of aftertreatment bricks include catalysts that chemically alter the exhaust gasses and filters that can trap specific components of the exhaust gasses. In some embodiments, the aftertreatment brick may be permanently fixed to the module, for example, by welding or the like. However, some types of aftertreatment bricks may become depleted or deactivated after a period of use, or may become damaged due to the conditions in which they are used, and require replacement. Accordingly, the aftertreatment system may be designed to facilitate replacement of the bricks.

An example of a replacement system for aftertreatment bricks, in particular catalysts, is described in U.S. Pat. No. 8,062,602 (the '602 patent). The '602 patent describes a catalyst disposed across the cross-section of an exhaust channel so as to be arranged perpendicularly to the exhaust flow. To retain the catalyst in place, a bolt and a jam nut arranged parallel to the exhaust flow may be threaded through an upstream portion of a housing body and tightened against the catalyst therein to urge the catalyst against a downstream portion of the housing body. However, access to the catalyst is achieved through an access door at a different location of the housing body. To replace the catalyst, the bolt and jam nut must be loosened, and the depleted catalyst removed through the access door, thereby resulting in complicated two-step process.

SUMMARY

The disclosure describes, in one aspect, an aftertreatment module including a sleeve extending between a first end and a second end to delineate a sleeve axis. The sleeve can include an opening formed at the first end. The aftertreatment module also includes at least one aftertreatment brick inserted axially in the sleeve. The aftertreatment brick includes a substrate matrix and a mantle disposed around the substrate matrix. The mantle of the aftertreatment brick includes a lip that, when the aftertreatment brick is inserted in the sleeve, extends through the opening of the sleeve. To retain the aftertreatment brick in the sleeve, a channel pocket may be secured proximate to the opening of the sleeve and oriented radially outward with respect to the sleeve axis. The aftertreatment module includes a clamping arrangement with a hook, a fastener, and a capture nut receivable in the channel pocket. The hook engages the lip of the aftertreatment brick and the fastener secures the hook to the capture nut received in the channel pocket.

In another aspect, the disclosure describes a method for retaining an aftertreatment brick in an aftertreatment module. According to the method, an aftertreatment brick is inserted into a longitudinal sleeve through an opening. The aftertreatment brick includes a lip and is inserted so that the lip protrudes from the opening. According to the method, a hook engages the lip so that the aftertreatment brick is retained in the longitudinal sleeve. The hook is secured to a structural portion of the aftertreatment module.

In yet another aspect, the disclosure describes a kit for retaining an aftertreatment brick in an aftertreatment module having an elongated sleeve with an opening for receiving the aftertreatment brick. The aftertreatment module also includes a channel pocket mounted proximate the opening. The kit includes a hook with a barb adapted to engage a lip of the aftertreatment brick protruding from the opening of the sleeve. The kit also includes a capture nut adapted for accommodation in the channel pocket and a fastener for securing the hook to the capture nut.

DETAILED DESCRIPTION

Figure 1:
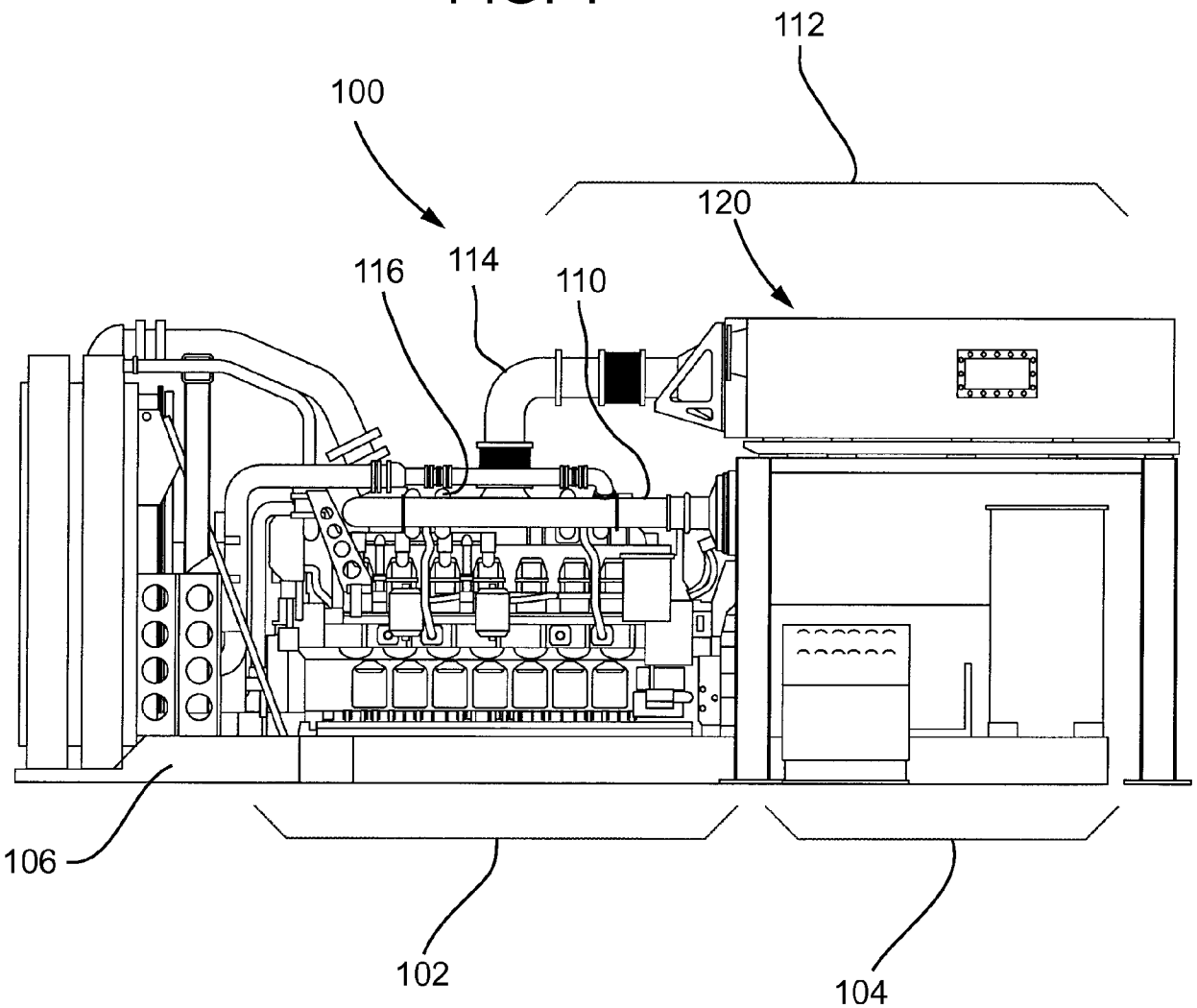
FIG. 1 is a side elevational view of a power system including an internal combustion engine coupled to a generator and associated with a clean emissions module.

This disclosure relates generally to an exhaust aftertreatment system that may be associated with a power system producing exhaust gasses and, more particularly, relates to aftertreatment bricks that may be a removable component of such aftertreatment systems. Now referring to the drawings, wherein like reference numbers refer to like elements, there is illustrated in FIG. 1 an example of a power system 100 that can generate power by combusting fossil fuels or the like. The illustrated power system 100 can include an internal combustion engine 102 such as a diesel engine operatively coupled to a generator 104 for producing electricity. The internal combustion engine 102 may have any number of cylinders as may be appreciated by one of ordinary skill in the art. The internal combustion engine 102 and the generator 104 can be supported on a common mounting frame 106. The power system 100 can provide on-site stand-by power or continuous electrical power at locations where access to an electrical grid is limited or unavailable. Accordingly, the generator 104 and internal combustion engine 102 can be scaled or sized to provide suitable wattage and horsepower. It should be appreciated that in other embodiments, the power system of the present disclosure can be utilized in other applications such as gasoline burning engines, natural gas turbines, and coal burning systems. Further, in addition to stationary applications, the present disclosure can be utilized in mobile applications such as locomotives and marine engines.

To direct intake air into and exhaust gasses from the power system 100, the power system can include an air introduction system 110 and an exhaust system 112. The air introduction system 110 introduces air or an air/fuel mixture to the combustion chambers of the internal combustion engine 102 for combustion while the exhaust system 112 includes an exhaust pipe or exhaust channel 114 in fluid communication with the combustion chambers to direct the exhaust gasses produced by the combustion process to the environment. To pressurize intake air by utilizing the positive pressure of the expelled exhaust gasses, the power system 100 can include one or more turbochargers 116 operatively associated with the air introduction system 110 and the exhaust system 112.

The exhaust system 112 can include components to condition or treat the exhaust gasses before they are discharged to the environment. For example, an exhaust aftertreatment system 120 in the form of a clean emissions module (CEM) can be disposed in fluid communication with the exhaust system 112 downstream of the turbochargers 116 to receive the exhaust gasses discharged from the internal combustion engine 102. The term "aftertreatment" refers to the fact that the system treats exhaust gasses after they have been produced and is therefore distinguishable from fuel additives and the like that affect the combustion process. The aftertreatment module 120 can be designed as a separate unit that can be mounted to the power system 100 generally over the generator 104, for example, and can receive exhaust gasses from the exhaust channel 114. By manufacturing the aftertreatment system 120 as a separate modular unit, the design can be utilized with different sizes and configurations of the power system 100. However, in other embodiments, the aftertreatment system 120 can be integral with the power system 100 and can be disposed at other locations rather than above the power system. The aftertreatment system 120 can be configured to treat, remove or convert regulated emissions and other constituents in the exhaust gasses.

Figure 2:
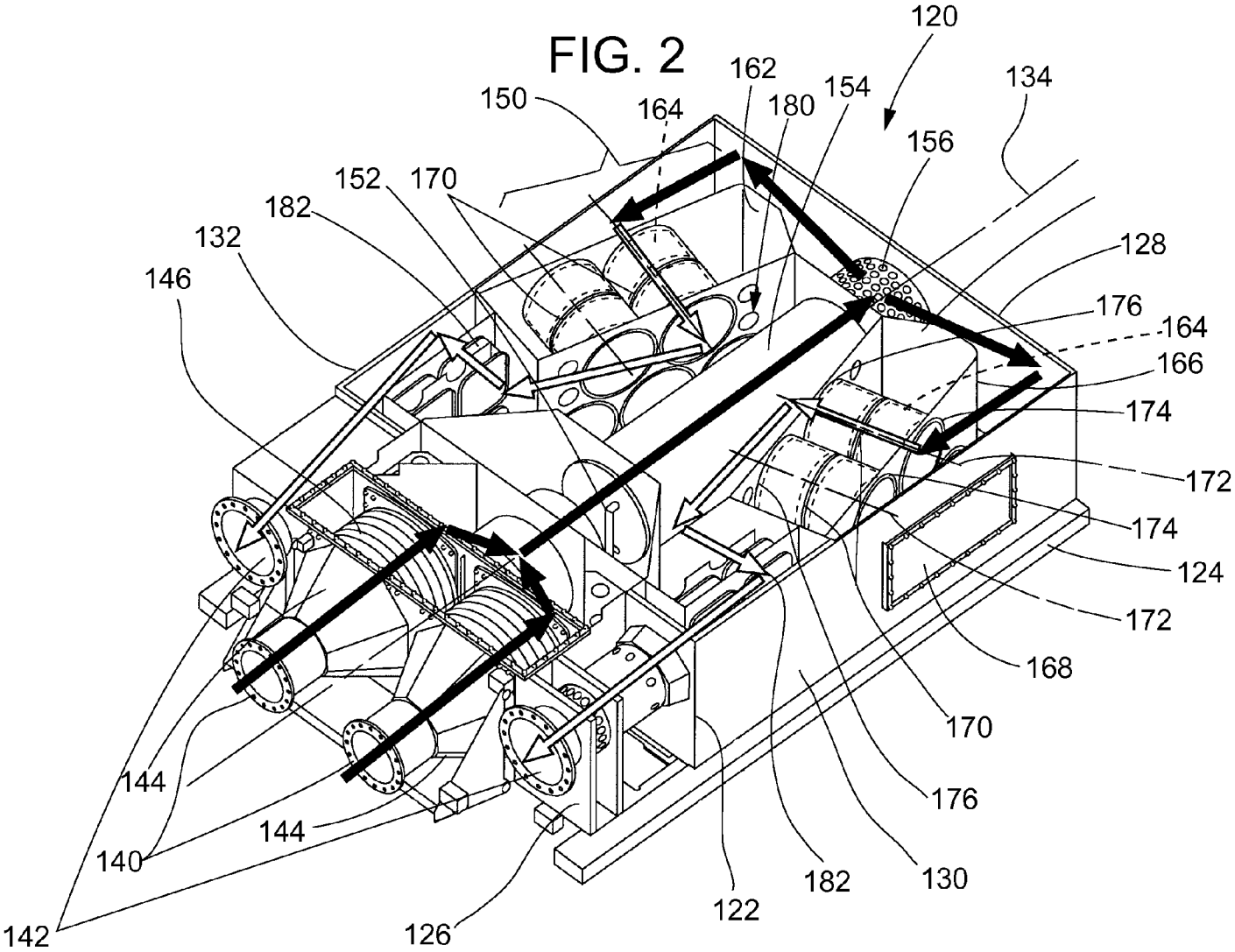
FIG. 2 is a perspective view of the clean emissions module with the top removed to illustrate the components inside of, and exhaust flow through, the module.

Referring to FIG. 2, the aftertreatment system 120 can include a box-like housing 122 that is supported on a base support 124 adapted to mount the aftertreatment system to the power system. The box-like housing 122 can include a forward-directed first wall 126, an opposing rearward second wall 128, and respective third and fourth sidewalls 130, 132. However, it should be appreciated that terms like forward, rearward and side are used only for orientation purposes and should not be construed as a limitation on the claims. Additionally, extending between the forward first wall 126 and rearward second wall 128 and located midway between the third and fourth sidewalls 130, 132 can be an imaginary central system axis line 134. The housing 122 may be made from welded steel plates or sheet material.

To receive the untreated exhaust gasses into the aftertreatment system 120, one or more inlets 140 can be disposed through the first wall 126 of the housing 122 and can be coupled in fluid communication to the exhaust channel from the exhaust system. In the embodiment illustrated, the aftertreatment system 120 includes two inlets 140 arranged generally in parallel and centrally located between the third and fourth sidewalls 130, 132 on either side of the system axis line 134 so that the entering exhaust gasses are directed toward the rearward second wall 128. However, other embodiments of the aftertreatment system 120 may include different numbers and/or locations for the inlets. To enable the exhaust gasses to exit the aftertreatment system 120, two outlets 142 can also be disposed through the first wall 126 of the housing 122. Each outlet 142 can be parallel to the centrally oriented inlets 140 and can be disposed toward one of the respective third and fourth sidewalls 130, 132.

To treat or condition the exhaust gasses, the housing 122 can contain various types or kinds of exhaust treatment devices through or past which the exhaust gasses are directed. For example and following the arrows indicating exhaust flow through the aftertreatment system 120, in order to slow the velocity of the incoming exhaust gasses for treatment, the inlets 140 can each be communicatively associated with an expanding, cone-shaped diffuser 144 mounted exteriorly of the front first wall 126. Each diffuser 144 can direct the exhaust gasses to an associated diesel oxidation catalyst (DOC) 146 located proximate the first wall 126 inside the housing 122 that then directs the exhaust gasses to a common collector duct 148 centrally aligned along the system axis line 134. The DOC 146 can contain materials such as platinum group metals like platinum or palladium which can catalyze carbon monoxide and hydrocarbons in the exhaust gasses to water and carbon dioxide via the following possible reactions:

$$CO+\tfrac{1}{2}O_2=CO_2 \quad (1)$$

$$[HC]+O_2=CO_2+H_2O \quad (2)$$

To further reduce emissions in the exhaust gasses and particularly to reduce nitrogen oxides such as NO and $NO_2$, sometimes referred to as $NO_X$, the aftertreatment system may include an SCR system 150. In the SCR process, a liquid or gaseous reductant agent is introduced to the exhaust system and directed through an SCR catalyst along with the exhaust gasses. The SCR catalyst can include materials that cause the exhaust gasses to react with the reductant agent to convert the $NO_X$ to nitrogen ($N_2$) and water ($H_2O$). A common reductant agent is urea ($(NH_2)_2CO$), though other suitable substances such as ammonia ($NH_3$) can be used in the SCR process. The reaction may occur according to the following general formula:

$$NH_3+NO_X=N_2+H_2O \quad (3)$$

Referring to FIG. 2, to introduce the reductant agent, the SCR system 150 includes a reductant injector 152 located downstream of the collector duct 148 and upstream of a centrally aligned mixing duct 154 that channels the exhaust gasses toward the rearward second wall 128 of the housing 122. The reductant injector 152 can be in fluid communication with a storage tank or reservoir storing the reductant agent and can periodically, or continuously, inject a measure of the reductant agent into the exhaust gas stream in a process sometimes referred to as dosing. The amount of reductant agent introduced can be dependent upon the $NO_X$ load of the exhaust gasses. The elongated mixing duct 154 uniformly intermixes the reductant agent with the exhaust gasses before they enter the downstream SCR catalysts. Disposed at the end of the mixing duct 154 proximate the second wall 128 can be a diffuser 156 that redirects the exhaust gas/reductant agent mixture toward the third and fourth sidewalls 130, 132 of the aftertreatment system 120. The third and fourth sidewalls 130, 132 can redirect the exhaust gas/reductant agent mixture generally back towards the front first wall 126.

Figure 3:
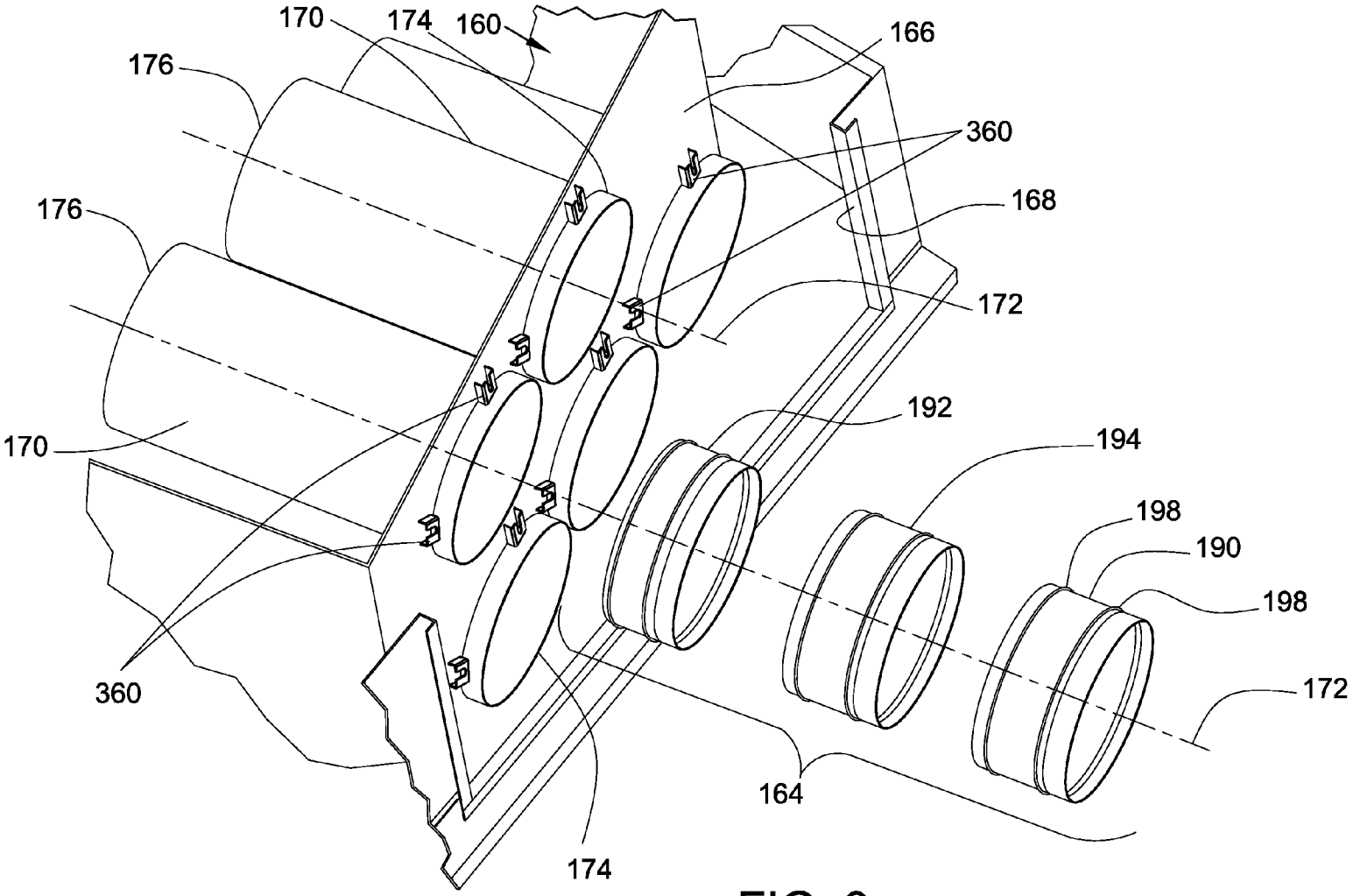
FIG. 3 is a perspective view of an aftertreatment module disposed in the clean emission module, the aftertreatment module including at least one sleeve receiving a plurality of aftertreatment bricks with at least one clamping assembly that is illustrated in detail.

To perform the SCR reaction process, the aftertreatment system 120 can include a first SCR module 160 disposed proximate the third sidewall 130 and a second SCR module 162 disposed toward the fourth sidewall 132. The first and second SCR modules 160, 162 are oriented to receive the redirected exhaust gas/reductant agent mixture. Referring to FIGS. 2 and 3, the first and second SCR modules 160, 162 can accommodate one or more SCR catalysts 164, sometimes referred to as aftertreatment bricks. The term aftertreatment brick, however, may refer to a variety of exhaust aftertreatment devices which SCR catalysts are a subset of. Moreover, in different embodiments, the SCR modules 160, 162 may be configured to accommodate any different number of aftertreatment bricks that may be in different shapes, sizes and/or configurations and that may operate by the same or different reaction processes. Accordingly, the described embodiments of aftertreatment bricks are by way of example only and should not be construed as limitations on the claims unless clearly stated otherwise.

To accommodate the plurality of SCR catalysts 164, the SCR modules 160, 162 can include one or more sleeves 170 that can slidably receive the catalysts. The sleeves 170 can be generally elongated, tubular structures having a first end 174 and an opposing second end 176 aligned along a longitudinal sleeve axis 172. In some embodiments, the first end 174 may be designated as an upstream end and the second end 176 may be designated as the downstream end thereby establishing the gas flow direction through the sleeve 170. In other embodiments, the flow direction through the SCR modules may be at least partially reversible so that either the first end or second end may function alternatively as the upstream or downstream ends. In those embodiments that include more than one sleeve 170 in the first and second SCR modules 160, 162, the sleeves can be supported in a truss or frame 166 made, for example, from formed sheet metal or cast materials. The frame 166 can be oriented so that the first ends 174 are directed toward the respective third and forth sidewalls 130, 132 and the second ends 176 communicate with a central region 180 of the aftertreatment system 120 generally surrounding but fluidly separated from the mixing duct 154. The central region 180 can direct the treated exhaust gasses forward to the outlets 142 disposed through the front first wall 126. In various embodiments, one or more additional exhaust treatment devices can be disposed in the aftertreatment system 20 such as diesel particulate filters 182 for removing soot.

Referring to FIGS. 2 and 3, to receive the plurality of SCR catalysts 164, the first end 174 of each tubular sleeve 170 can delineate an opening 178 through which the catalysts can be inserted. The sleeve 170 and the plurality of SCR catalysts 164 can have complementary cylindrical shapes, although in other embodiments, other shapes are contemplated. The plurality of SCR catalysts 164 can be aligned along the sleeve axis 172 and inserted through the opening 178 in the first end 174 and slid or pushed toward the second end 176. To install and remove the plurality of SCR catalysts 164 from the first and/or second SCR modules 160, 162, the aftertreatment system 120 can include removable access panels 168 disposed in the respective third and fourth sidewalls 130, 132 of the housing 122. The access panels 168 are oriented toward the SCR modules 160, 162 so as to provide easy access to the opened first ends 174 of the sleeves 170 and can be sized to allow easy transfer of a catalyst therethrough.

Figure 4:
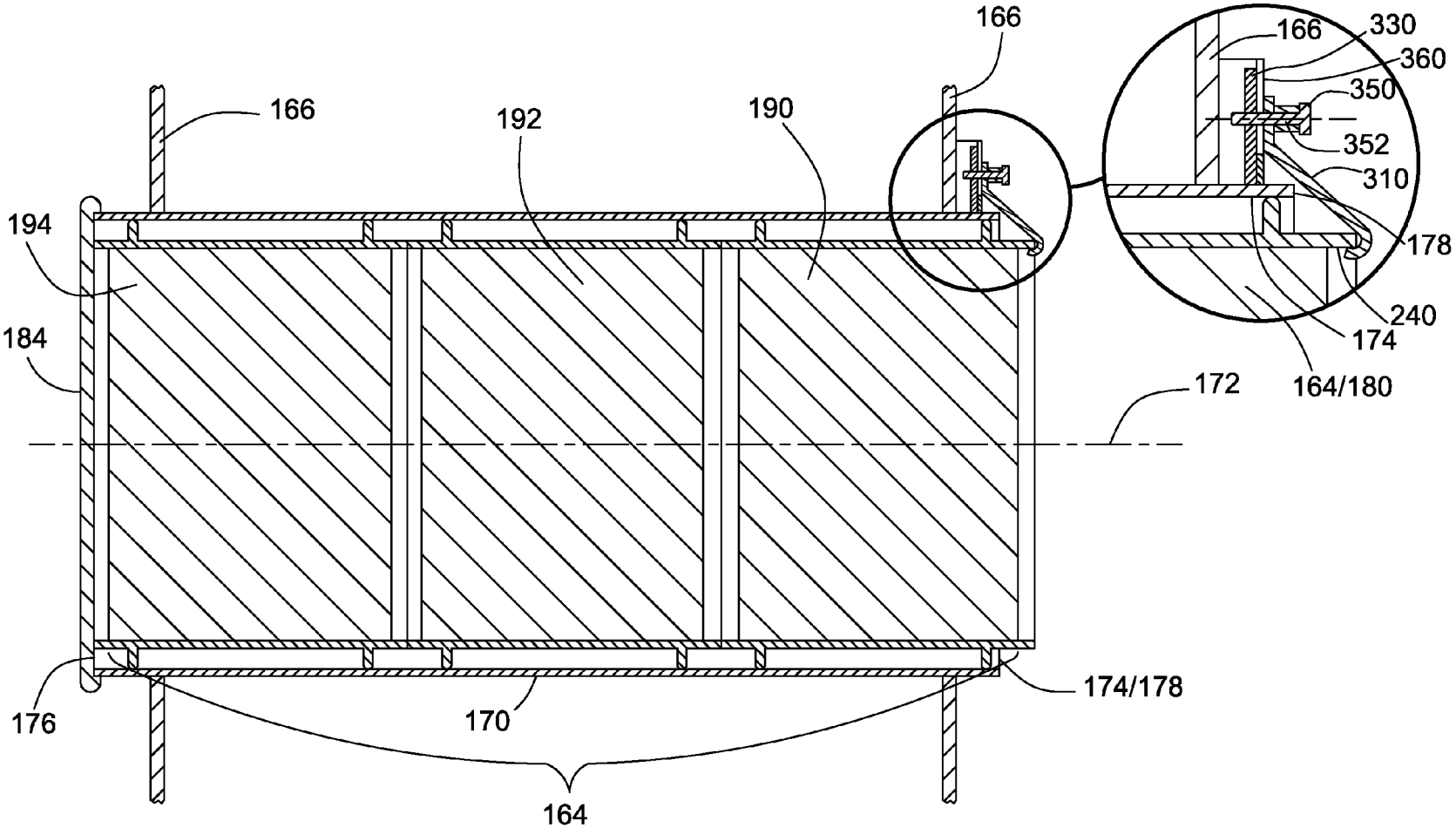
FIG. 4 is a cross-sectional view illustrating the plurality of aftertreatment bricks received in the sleeve and a cross section of the assembled clamping assembly illustrated in detail.

In different embodiments, each sleeve 170 can be sized to accommodate the plurality of SCR catalysts 164. For example, in the illustrated embodiment, the sleeve 170 can receive a first catalyst 190, a second catalyst 192 and a third catalyst 194 that are arranged and axially inserted in the sleeve. The first catalyst 190 can be oriented toward the first end 174, the second catalyst 192 can be oriented toward the second end 176, and the third catalyst 194 can be disposed in between the first and second catalysts. As illustrated in FIG. 4, once inserted, the plurality of SCR catalysts 164 are arranged in an abutting or stacked relationship within the sleeve 170 and may be confined within the sleeve at the second end 176 by a retainer 184. The retainer 184 may be a bar, a grate, or the like and functions to prevent the plurality of SCR catalysts 164 from entering the central region 180 while allowing fluid communication of the exhaust gasses between the sleeve 170 and the central region.

To facilitate insertion of the plurality of catalysts 164, a 2-3 millimeter gap may exist between portions of the catalysts and the sleeve 170. Further, to prevent leakage of the exhaust gasses/reductant agent mixture between the plurality of catalysts 164 and the sleeve 170, the two components can be adapted to form a sealing engagement with each other. For example, one or more circular protruding ribs 198 can protrude radially about the circumference of each of the plurality of SCR catalysts 164 and form a seal or slight interference fit with the inner surface of the sleeves 170. Due to the complementary fit between the sleeve 170 and the plurality of SCR catalysts 164, the catalysts can be positioned into concentric alignment with the sleeve axis 172. Further, the plurality of SCR catalysts 164 may have the same or different axial lengths and may be sized so that their combined length is slightly larger than the overall length of the sleeve 170 such that a portion of the first catalyst 190 protrudes from the opened first end 174.

Figure 5:
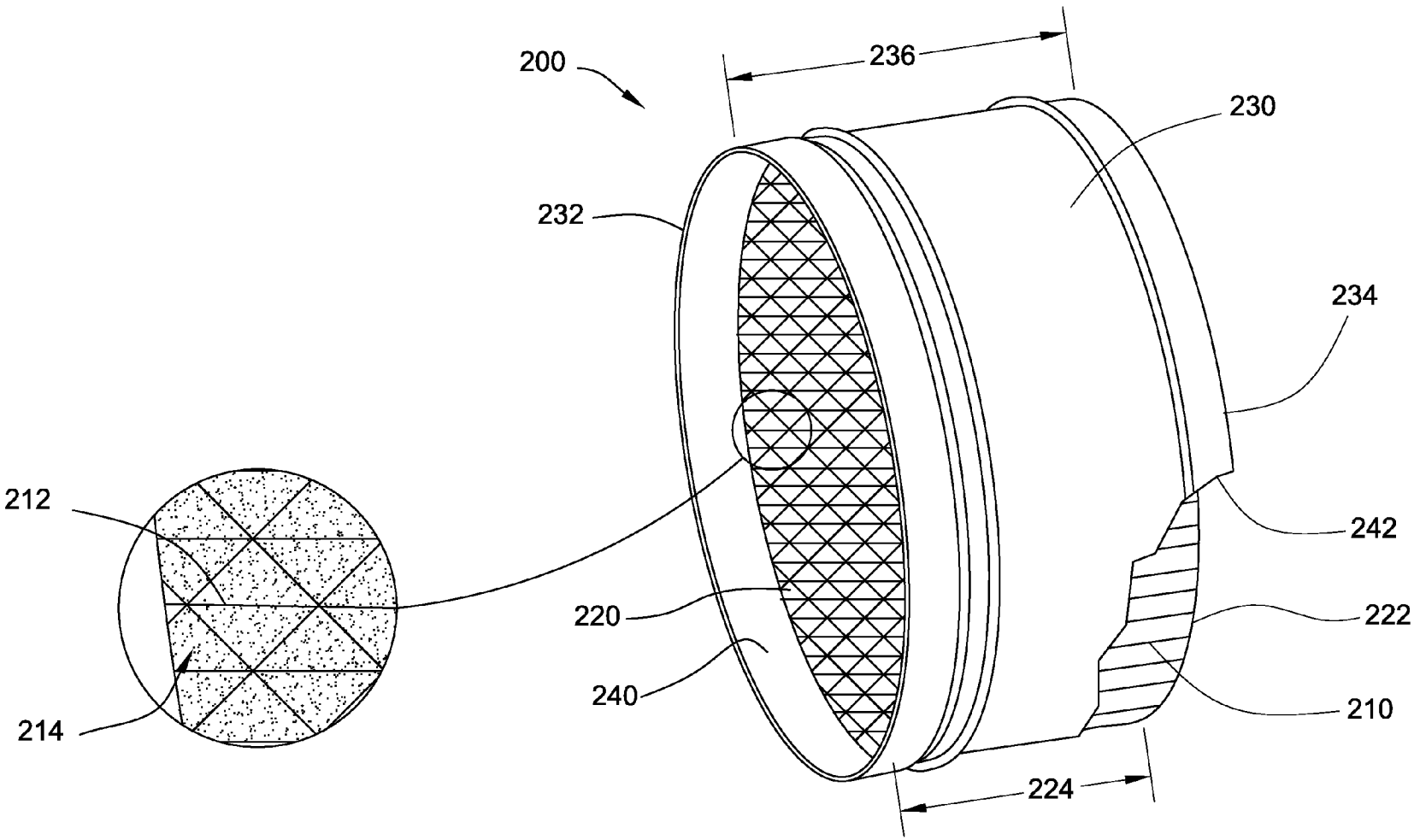
FIG. 5 is a perspective view of an embodiment of an aftertreatment brick, in particular, a selective catalytic reduction catalyst having a mantle disposed around a substrate matrix with the substrate matrix illustrated in detail.

The plurality of SCR catalysts 164 or other types of aftertreatment bricks used in the aftertreatment module can be flow-through devices so that the exhaust gasses/reductant agent mixture can pass through them and thus be channeled through the sleeve 170 and across the SCR module. Referring to FIG. 5, there is illustrated an embodiment of such a flow-through type aftertreatment brick and, specifically, a SCR catalyst 200 that can perform an SCR reaction. However, as stated elsewhere, the aftertreatment bricks of the present disclosure may take other embodiments and may perform different types of reactions or treatments on the exhaust gasses they encounter. To support the catalytic material that performs the chemical reaction, the SCR catalyst 200 can include an internal substrate matrix 210 made of a triangular lattice, honeycomb lattice, metal mesh substrate, or similar thin-walled support structure 212 onto which the catalytic material or catalytic coating 214 can be disposed. Such designs for the support structures enable the exhaust gas/reductant agent mixture to pass into and through the SCR catalyst 200. Any suitable material can be used for the support structure 212 including, for example, ceramics, titanium oxide, or copper zeolite. Catalytic coatings 214 that initiate the SCR reaction can include various types of metals such as vanadium, molybdenum and tungsten. The catalytic coating 214 can be deposited on the support structure 212 by any suitable method including, for example, chemical vapor deposition, adsorption, powder coating, spraying, etc. In other embodiments, instead of having separate support structures and catalytic coatings that are often employed together to reduce material costs, the substrate matrix can be made entirely from a catalytic material. In the illustrated embodiment, the substrate matrix 210 has a generally cylindrical shape and extends between a first circular face 220 and a second circular face 222 to delineate a first length 224, however, in other embodiments, different shapes can be applied to the substrate matrix, e.g., square, rectangular, etc. By way of example only, the first length may be about seven (7) inches long.

To protect the support structure 212, a tubular mantle 230 can be generally disposed around the substrate matrix 210. The tubular mantle 230 can be made of a thicker or more rigid material than the thin-walled support structure 212, such as aluminum or steel. For example, the mantle may be about 1.2 millimeters thick to provide sufficient structural rigidity to the catalyst. The tubular mantle 230 can have a shape complementary to that of the substrate matrix 210 which, in the illustrated embodiment, is generally cylindrical. The cylindrical mantle 230 can therefore extend between a first circular rim 232 and a second circular rim 234. However, in other embodiments the mantle and its first and second rims can have other shapes. The mantle can have a second length 236 delineated between the first rim 232 and a second rim 234 that is slightly larger than the first length 224 of the substrate matrix 210. By way of example only, the second length 236 may be approximately eight (8) inches.

Accordingly, when disposed around the shorter substrate matrix 210, the mantle 230 can have an overhanging extension or lip 240 protruding beyond at least the first face 220 of the substrate matrix. The lip 240 therefore displaces the first rim 232 a short distance beyond the first face 220. In those embodiments in which the shorter substrate matrix 210 is centered at a mid-length position with respect to the longer mantle 230, a second lip 242 may protrude beyond the second face 222 of the matrix and displace the second rim 234 from the second face. For the examples given above, with the length of the substrate matrix 210 being 7 inches and the length of the mantle being 8 inches, the first and second lips 240, 242 may be on the order of one-half inch (½) inch. By extending the first and second lips 240, 242 beyond the substrate matrix 210, possible damage to the thin-walled matrix may be avoided if, for instance, a plurality of catalysts are staked in an abutting relation together by reducing the potential for the matrix to contact an adjacent catalyst.

Figure 6:
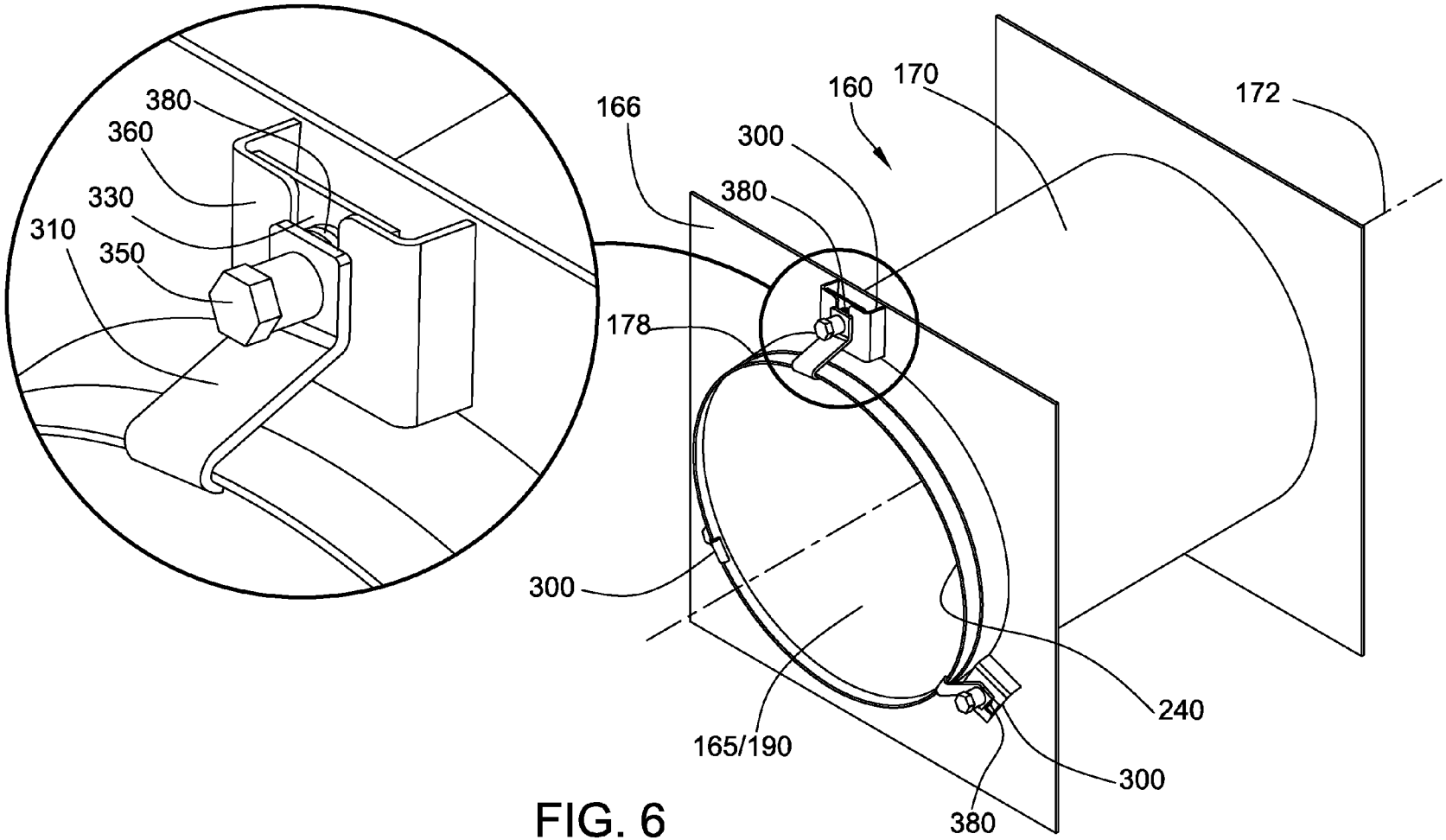
FIG. 6 is a perspective view of an aftertreatment brick received and partially protruding from the sleeve and engaged with an assembled clamping assembly illustrated in detail.

Referring to FIGS. 4 and 6, to retain the aftertreatment bricks like the plurality of SCR catalysts 164 inserted in the sleeves 170, the catalysts can engage with one or more releasable clamping assemblies 300 that may be fixed with respect to the frame 166 of the first SCR module 160. Similar clamping assemblies can also be disposed on the second SCR module 162. The clamping assemblies 300 per sleeve 170 can be disposed about the circumference of the opened first end 174 of the sleeves. In the specific embodiment, three clamping assemblies 300 are mounted to the fame 166 supporting the sleeves but in other embodiments, greater or lesser numbers of clamping arrangements can be included. The three clamping assemblies 300 can be evenly spaced from each other radially around the opening 178. A portion of each of the clamping assemblies 300 can extend radially inward with respect to the sleeve axis 172 and partly across or into the opening 178 to engage the portion of the first SCR catalyst 190 protruding from the sleeve 170. The clamping assemblies 300 thereby prevent movement of the plurality of SCR catalysts 164 with respect to the sleeve axis 172 and function to prevent the catalysts from unintentionally sliding axially outward from the sleeve 170.

To engage with and releasable secure the plurality of SCR catalysts 164 in the sleeve 170, the clamping assemblies 300 may include one or more components such as, in the illustrated embodiment, a hook 310 and a capture nut 330 that can be joined together by a fastener 350. Referring to the detailed views in FIGS. 4 and 6, the capture nut 330 can be mounted or held adjacent to the fame 166 of the SCR module 160 by, for instance, attachment directly to the frame or, in the illustrated embodiment, by accommodating the capture nut in a channel pocket 360 attached to the frame 166. The hook 310 can extend from the capture nut 330 around the first end 174 into the sleeve 170. To facilitate this extension, the hook 310 can have a curved or serpentine shape. Specifically, referring to FIG. 7, the hook 310 can include a first leg or bearing leg 312 having a planar shape and a second angled leg 314 extending from the bearing leg at an offset angle 316. Disposed at the distal end of the angled leg 314 can be a barb 318 that hooks or is directed generally back toward a plane defined by the bearing leg 312. The offset angle 316 can be an acute angle of any suitable degree and the angled leg 314 can have any suitable length to enable the hook 310 to extend around the sleeve. The bearing leg 312 may also include a protruding standoff 320 extending in the same general direction as the angled leg 314 and having an aperture 322 disposed through the standoff. The hook 310 can be made from any suitable, rigid material such as, for example steels or stainless steels.

Figure 7:
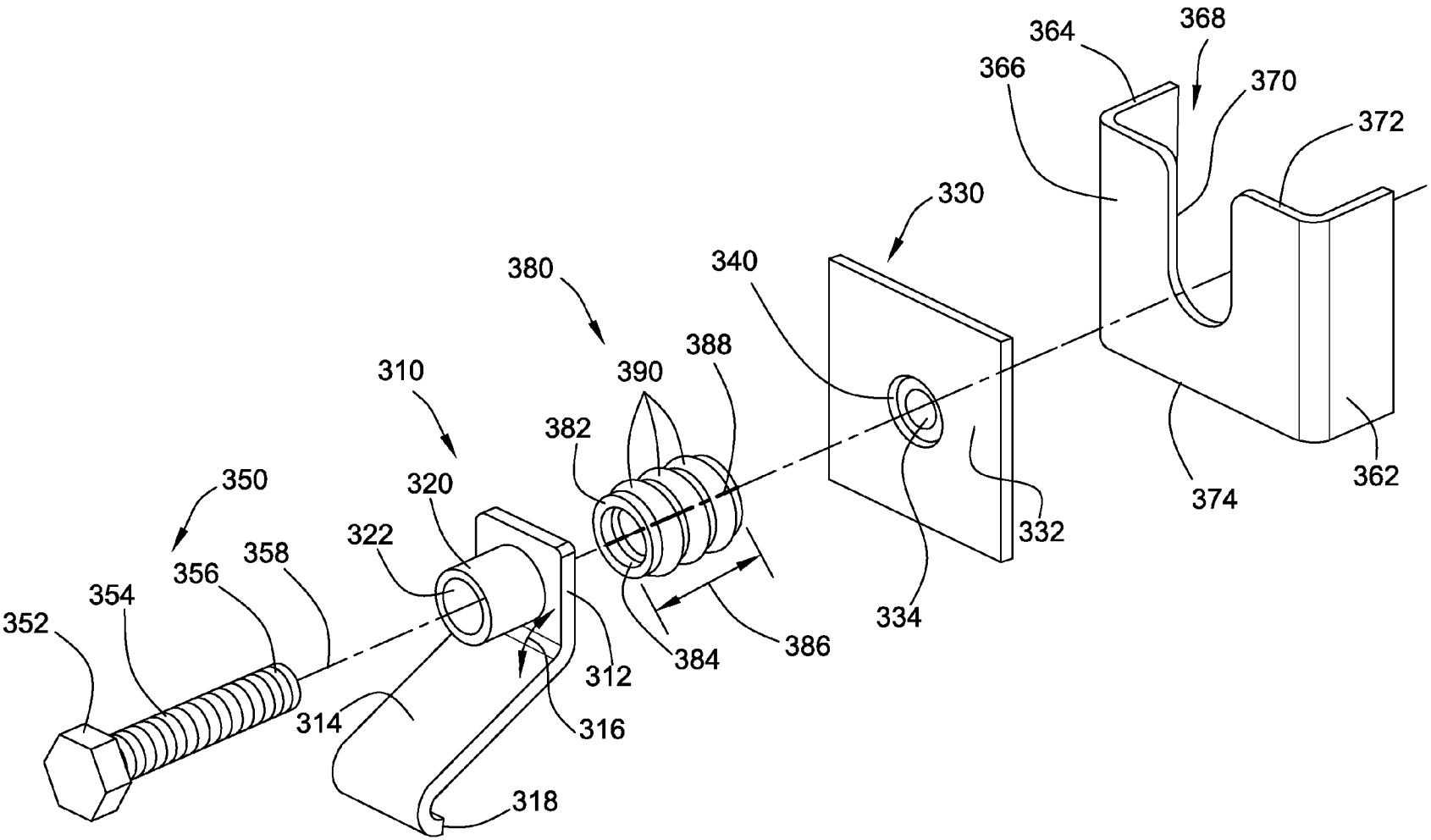
FIG. 7 is an exploded assembly view of the different components of the clamping assembly for retaining the aftertreatment brick in the sleeve.

To fasten the hook 310 and capture nut 330 together, the fastener 350 can be an elongated, threaded bolt although in other embodiments different types of fasteners may be used. The illustrated fastener 350 may therefore include a bolt head 352 disposed at one end and an elongated rod 354 extending from the bolt head and having a threaded end 356 distally positioned from the bolt head. The bolt head 352 may be a hex head adapted to engage a socket driver or may have one more slots disposed in it to engage a screwdriver. The elongated shape of the fastener 350 may also delineate a fastener axis 358. To threadably engage the fastener 350, the capture nut 330 can include a body or plate 332 with a central threaded aperture 334 disposed through it. Disposed around the threaded aperture 334 can be a circular countersink or counterbore 340. In the illustrated embodiment, the plate 332 can have a square or rectangular outline or plate perimeter 338 although in other embodiments, the capture nut 330 can have other suitable shapes. Referring to FIG. 7, to assemble the components, the hook 310, capture nut 330 and fastener 350 can be aligned along the fastener axis 358 with the bearing leg 312 of the hook adjacent the plate 332 of the nut and with the fastener passing through the aperture 322 in the standoff 320 to threadably mate with the threaded aperture 334. The capture nut 330 and the fastener 350 can be made from any suitable material, can be coated or plated, and, in an embodiment, can be of the same material as the hook 310.

In order to couple or join the assembled components of the clamping assembly 300 to the SCR module 160, referring to FIGS. 4, 6, and 7, one or more of the channel pockets 360 can be mounted to the frame 166 of the module proximately around the opened first ends 174 of the sleeves 170. In the illustrated embodiment, the channel pockets 360 can resemble a U-shaped bracket or structure with a first depending leg 362, a spaced apart second depending leg 364, and a relatively flat faceplate 366 extending between and joined substantially perpendicularly or at a right angle to the first and second depending legs. The U-shaped channel pocket 360 can be made from formed or pressed metal, such as the same or different metal as the hook 310, and can be joined to the frame 166 of the SCR module 160 by any suitable method including welding, brazing or the like. When joined to the frame 166, the first and second dependent legs 362, 364 may physically contact the SCR module 160 so that the faceplate 366 is spaced apart from the frame 166 thereby delineating a cavity-like void or pocket 368. The cavity or pocket 368 can correspond in shape to the flat faceplate 366 and be generally rectangular or square in shape and sized to accommodate the correspondingly shaped capture nut 330.

To access the pocket 368 when the channel pocket 360 is attached to the frame 166, a slot or channel 370 can be disposed into the faceplate 366. In the illustrated embodiment, the channel 370 can extend from a first lateral free edge 372 of the square or rectangular faceplate 366 partially toward a parallel second lateral free edge 374. The channel pocket 360 can be secured to the frame 166 so that the channel 370 is directed radially outward from the sleeve axis 172. In this arrangement, the second lateral free edge 374 may be tangentially proximate the first end 174 of the sleeve 170 so that the pocket 368 is generally closed off along that edge. Access to the pocket 368, other than through the channel 370, may thus occur only through the gap between the first lateral free edge 372 and the sleeve 170. In the embodiment having three clamping assemblies per sleeve 170, three corresponding channel pockets 360 can be included and arranged as illustrated in FIG. 3.

Referring to FIG. 7, in a further embodiment, the clamping assembly 300 can include an additional component in the form of a compression body 380 to provide a tensioning force to hold the components of the clamping assembly in rigid alignment when assembled. The compression body 380 can include a unitary tubular sleeve 382 having a longitudinal bore 384 disposed through it. The longitudinal bore 384 can thereby delineate a longitudinal axis 388, indicted by the heavier centerline. Moreover, the longitudinal bore 384 can be sized and shaped to clearly receive the elongated fastener 350 when the compression body 380 and the longitudinal axis 388 are properly aligned with the fastener axis 358. The compression body 380 can have an initial longitudinal dimension 386, indicated in FIG. 7 by the arrow. When part of the clamping assembly, the compression body 380 may be partially received or set in the counterbore 340 formed in the capture nut 330.

Formed in the compression body 380 can be a plurality of adjacent beads 390 arranged longitudinally and aligned along the longitudinal axis 388. The rounded beads 390 may provide the compression body 380 with a buckled or corrugated shape. To form the beads 390, the tubular sleeve 382 may be initially cylindrical and maybe cold worked into the beaded shape by a turning operation. If the compression body 380 is placed under an axially compressive force asserted, for example, between the hook 310 and the capture nut 330, the adjacent beads 390 can begin to collapse together with respect to the longitudinal axis 388, similarly to the collapsing of a bellows. Accordingly, the tubular body 382 may begin to crush or collapse with respect to its initial longitudinal dimension 386. In return, the collapsing beads 390 may provide a resistive force or counter compressive force in the direction of the longitudinal axis 388.

When the compression body 380 is compressed in the clamping assembly 300, this force may cause the other components to urge against each other helping to hold the individual components in a rigid arrangement. The number of adjacent beads 390 and the size of the beads can be varied to provide for different ranges of collapse (i.e. different changes in the initial longitudinal dimension 386) and different degrees of counterforce. The compression body 380 may therefore act or function as a spring or tensioning mechanism. To enable the compression body 380 to collapse, the tubular sleeve 382 can be made from a relatively more pliable grade of material than the other components of the clamping arrangement, such as a lower grade of stainless steel. In other embodiments, the clamping assembly 300 may include other devices like springs to provide the counterforce.

Referring to FIGS. 4, 6 and 7, to assemble the clamping assembly 300 to retain the plurality of SCR catalysts 164, the catalysts are first inserted into the elongated sleeve 170 such that the first catalyst 190 partially protrudes from the sleeve. To rigidly orientated and secure the capture nut 330 with respect to the first end 174 of the sleeve 170, the capture nut is slid or inserted into the pocket 368 of the channel pocket 360 through the gap between the first lateral free edge 372 and the frame 166. The corresponding shapes of the capture nut 330 and pocket 368 align the threaded aperture 334 of the nut with the channel 370. The hook 310 can engage the protruding lip 240 of the catalyst by the barb 318 while the bearing leg 312 can be oriented toward the faceplate 366 of the channel pocket 360. In those embodiments including the compression body 380, the compression body is placed between the hook 310 and the capture nut 330. The components are arranged so that the aperture 322 in the hook 310, the longitudinal bore 384 of the compression body 380, the channel 370 of the channel pocket 360, and the threaded aperture 334 of the compression nut 330 are aligned with the fastener axis 358. Furthermore, the fastener axis 358 is substantially parallel with the sleeve axis 172. The fastener 350 can be inserted through the components and threadably mated with the capture nut 330 captured in the channel pocket 360. Tightening of the fastener 350 can compress the compression body 380 as illustrated in FIG. 6. Tightening of the fasteners 350 may also direct an axial force generally parallel to the sleeve axis 172 transferred through the abutting rims 232, 234 of the relatively stronger, exterior mantles 230 of the plurality of SCR catalysts 164. The plurality of SCR catalysts 164 are thereby held or constrained in the sleeve 170.

INDUSTRIAL APPLICABILITY

As indicated above, the clamping assembly can be used to retain aftertreatment bricks such as SCR catalysts in an aftertreatment system such as the large exhaust aftertreatment system 120 or CEM illustrated in FIG. 1. The described clamping arrangement may provide a number of possible advantages. For example, referring to FIGS. 4, 6, and 7, the clamping assemblies 300 engages with a lip 240 of the first SCR catalyst 190 protruding from the sleeve 170, which offers a suitable engagement point for the hook 310. Furthermore, because the lip 240 protrudes beyond the first face of the substrate matrix, the hook 310 is unlikely to contact and potentially damage the possibly delicate substrate matrix. In the embodiments wherein the fastener axis 358 is aligned with the sleeve axis 172 and a plurality of clamping assemblies 300 per sleeve are used, the clamping assemblies can apply an evenly distributed axial force to the plurality of SCR catalysts 164 stacked in the sleeve. This arrangement may further assist avoiding damage as the plurality of SCR catalysts 164 axially abut each other against the protruding lips 240, 242 that are part of the relatively stronger, outer protective mantle 230.

In those embodiments that include a compression body 380, the compression body may provide an axially directed force that further restrains unintended movement of the plurality of SCR catalysts 164 and may prevent unintentional disassembly of the clamping assembly 300. Because the individual compression bodies 380 in the each of the plurality of clamping assemblies 300 may independently compress to different degrees of deformation, the arrangement of the clamping assemblies can account for varying tolerance stack-ups arising in the abutting plurality of SCR catalysts 164. Further, the compression bodies can accommodate misalignment or disorientation between adjacent catalysts due to manufacturing discrepancies or improper insertion into sleeves. The spring forces exerted by the compression bodies 380 may also accommodate thermal expansion and contraction of the plurality of SCR catalysts 164 and other clamping assembly components due to the heated exhaust gasses directed through or around them. The compression bodies 380 may also account for creep or set between the components overtime.

Because the clamping assembly 300 utilizes threaded fasteners 350, removal and replacement of damaged or depleted catalysts or aftertreatment bricks is facilitated. An operator can unfasten the fasteners to disassemble the clamping arrangements and remove the catalysts. If undamaged, the fastener and other components of the clamping assembly can be reused. However, due to the operating conditions of the clamping assembly 300 including exposure to heated exhaust gasses, the metallic components of the clamping assembly may undergo a galling process over time in which the adjacent surfaces adhere at a microscopic level and materials transfer or join between the components. Another possibility is that possibly corrosive compositions in the exhaust gasses and/or reductant agent may corrode the components of the clamping assembly together. Accordingly, to disassemble the clamping assembly 300 for catalyst removal, the fastener 350, hook 310 or another component may be cut or severed by, for example, cutting, clipping, grinding, or torching.

Because destruction of the clamping components prevents their reuse, the disclosure in another aspect provides for a replacement kit of the components of the clamping assembly 300 including, for example, the hook 310, the capture nut 330, the fastener 350, and, in an embodiment, the compression body 380. The kit can be reused with the same channel pocket 360 fixed to the frame 166 of the SCR modules. The kit and possible reuse of the channel pockets 360 thus facilities replacement of catalysts in the event of galling or corrosion. In some embodiments, the channel pocket 360 may be provided with the kit to facilitate retrofitting of existing exhaust aftertreatment systems. The channel pockets 360 can be welded or otherwise attached at an appropriate location to the frame 166 of an existing SCR module 160 and the rest of the clamping component can be used to restrain the plurality of SCR catalysts 164. Hence, the previous permanent or complex methods of securing aftertreatment bricks are overcome by the disclosed clamping arrangement.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. An aftertreatment module comprising:

a sleeve extending between a first end and a second end along a sleeve axis, and an opening formed at the first end of the sleeve;

an aftertreatment brick inserted axially in the sleeve, the aftertreatment brick including a substrate matrix and a mantle disposed around the substrate matrix, the mantle including a lip extendable through the opening of the sleeve;

a channel pocket secured proximate to the opening of the sleeve and oriented radially outward with respect to the sleeve axis; and a clamping assembly including a hook, a fastener, and a capture nut receivable in the channel pocket, wherein the hook engages the lip and the fastener secures the hook to the capture nut received in the channel pocket.

2. The aftertreatment module of claim 1, wherein the clamping assembly further includes a compression body delineating a bore for receiving the fastener through the compression body.

3. The aftertreatment module of claim 2, wherein the fastener and the bore of the compression body align along a fastener axis that is substantially parallel to the sleeve axis.

4. The aftertreatment module of claim 3, wherein the compression body includes a plurality of beads longitudinally aligned along the bore and configured to longitudinally collapse with respect to the fastener axis under application of a compressive force.

5. The aftertreatment module of claim 1, wherein the channel pocket is a U-shaped structure including a faceplate extending between a first depending leg and a second depending leg, the channel pocket providing a pocket between the faceplate and the first and second depending legs for accommodating the capture nut.

6. The aftertreatment module of claim 5, wherein the faceplate has a channel disposed therein from an edge toward a center of the faceplate, the channel oriented radially outward from the sleeve.

7. The aftertreatment module of claim 1, wherein the substrate matrix extends between a first face and a second face, and the lip extends beyond the first face.

8. The aftertreatment module of claim 7, wherein the substrate matrix has a cylindrical shape, and the mantle is tubular and disposed around the cylindrical shape of the substrate matrix, and the lip is circular.

9. A method of retaining an aftertreatment brick in an aftertreatment module, the method comprising: inserting an aftertreatment brick into a sleeve of an after treatment module, the aftertreatment brick including a lip and inserted so that the lip protrudes from an opening of the sleeve; engaging the lip with a hook so that the aftertreatment brick is retained in the sleeve; and securing the hook to the aftertreatment module.

10. The method of claim 9, wherein the sleeve delineates a sleeve axis, and engagement of the hook and the lip constrains movement of the longitudinal sleeve along the sleeve axis.

11. The method of claim 10, further comprising:

receiving a capture nut in a channel pocket mounted to the aftertreatment module proximate the opening of the sleeve; and fastening the hook to the capture nut with a fastener.

12. The method of claim 11, wherein the fastener is aligned along a fastener axis that is substantially parallel to the sleeve axis.

13. The method of claim 12, further comprising compressing a compression body between the fastener and the capture nut to assert a counter-force along the fastener axis.

14. The method of claim 13, further comprising inserting a plurality of aftertreatment catalysts into the sleeve.

15. The method of claim 11, further comprising removing the aftertreatment brick by the step of: i) unfastening the fastener from the capture nut; or ii) severing the fastener from the capture nut.

* * * * *